US006088555A

United States Patent [19]

Mizuno

[11] Patent Number: 6,088,555

[45] **Date of Patent: *Jul. 11, 2000**

[54] CARTRIDGE AND METHOD OF INSERTING IT AND IMAGE FORMING DEVICE USING THESE

[75] Inventor: Hiroshi Mizuno, Aichi-Ken, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,977

[22] Filed: Mar. 27, 1998

[30] Foreign Application Priority Data

Mar. 28, 1997 [JP] Japan ..... 9-078067

[51] Int. Cl.[7] ..... G03G 21/18

[52] U.S. Cl. ..... 399/113; 399/111

[58] Field of Search ..... 399/107, 110, 399/111, 113, 116, 119

[56] References Cited

U.S. PATENT DOCUMENTS

| | | | |
|---|---|---|---|
| 4,386,838 | 6/1983 | Hirabayashi et al. | 399/113 |
| 4,757,344 | 7/1988 | Idenawa et al. | 399/113 |
| 5,537,187 | 7/1996 | Sekine | 399/113 |
| 5,587,769 | 12/1996 | Sawada et al. | 399/113 |
| 5,752,137 | 5/1998 | Haneda | 399/113 X |
| 5,822,655 | 10/1998 | Ikeda | 399/113 X |

FOREIGN PATENT DOCUMENTS

| | | |
|---|---|---|
| 4-66964 | 3/1992 | Japan . |

*Primary Examiner*—Sandra Brase
*Attorney, Agent, or Firm*—Burns, Doane, Swecker & Mathis, LLP

[57] ABSTRACT

When, in devices of various types, a plurality of cartridges 3 and 5 are inserted into prescribed positions of a main device body with a prescribed sequence and a prescribed insertion path formed with guides 16 and 17, the cartridge 5 that is next to be inserted into the main device body 1 is inserted into its prescribed position in main device body 1 by guidance or accompanied by guidance from a guide section 51 provided on cartridge 3 that is previously inserted into its prescribed position in main device body 1. By means of this construction, it is made easy for the operator to notice incorrect insertion where there are a plurality of cartridges and correct cartridge insertion is facilitated.

14 Claims, 10 Drawing Sheets

CARTRIDGE AND METHOD OF INSERTING IT AND IMAGE FORMING DEVICE USING THESE

BACKGROUD OF THE INVENTION

1. Technical Field of the Invention

This application is based on application No. 9-78067 filed in Japan, the contents of which is hereby incorporated y reference.

The present invention relates to a cartridge and method of inserting it and an image forming device using these, and more particularly to a plurality of cartridges that are removably inserted into prescribed positions in the main body of a device by a prescribed insertion path formed with a guide and in a prescribed order, a method of inserting these into the main device body and an image forming device using these.

2. Description of Related Art

Such cartridges are employed in various types of device, in which maintenance and management are made more convenient by arranging for insertion into and removal from the main body of the device of respectively different cartridges in accordance with differences in type and life etc. of the portion constituted by the cartridge.

For example, in an image forming device in which the electrophotographic system is adopted, the image carrier and the means for exposure whereby a latent image is formed on the image carrier by image exposure, the developer whereby the latent image is converted into a positive image, and the means for transfer whereby the positive image obtained by development on the image carrier is electrostatically transferred on to a transfer material, which are all provided around the image carrier for image formation, are respectively required to be located in position with high accuracy in order to satisfy recent demands for improved image quality.

On the other hand, since the toner that is accommodated in the developer gets used up, it is necessary either to replenish the toner or to change the developer itself. Also, the image carrier is subject to wear due to scraping etc. for purposes of cleaning its surface after transfer has been effected by means for cleaning and its photoelectric characteristic deteriorates with time, necessitating repair or replacement. Organic photosensitive bodies in particular are subject to considerable problems regarding scraping and their life is shorter than that of other types.

For example, Japanese Published Unexamined Patent Application No. 1-308675 discloses an arrangement in which the developer and image carrier are constituted by a unitary cartridge, so that both can be replaced simultaneously. However, an image forming device exemplified by a laser printer that outputs image information from a computer is made of particularly small size and the developer is of correspondingly small capacity. The cycle time required for replacement of the developer is therefore shorter than in the case of the image carrier. There is therefore the inconvenience that if both the developer and image carrier are replaced at once, the image carrier is replaced early before being used to its full life. The developer and image carrier are therefore sometimes constituted as respectively different cartridges so that they can be replaced separately.

If there are a plurality of demountable cartridges, in order for these to be inserted without interference with the various sections of the main device body and to be used whilst maintaining a highly precise mutual positional relationship, an ideal method is to arrange for the cartridges to be inserted and removed in a prescribed order along a prescribed insertion path by means of a guide.

However, the insertion sequence may not necessarily be observed and, if the cartridges are inserted in the wrong order, it may be possible to insert neither cartridge correctly and they may be damaged by interference with each other. Also, the insertion path as described above tends to be long and complicated. For example, in the case of providing such a function that, when a cartridge is inserted or removed along the insertion path, a shutter provided on one or both of the relatively moving objects is automatically opened and closed utilizing relative movement with another cartridge or other member, an insertion path of special shape may be further required, causing the whole insertion path to be more complicated. Thus, correct insertion of a plurality of cartridges along a long and complicated path to prescribed positions within the main device body may not be easy and is an unreliable process. And in fact sometimes not all the cartridges may be inserted. If therefore the device should happen to be actuated in a condition with the cartridges not properly inserted or with only some cartridges inserted, problems arise such as that the objective of actuation is not achieved as expected and that the various sections may get damaged due to operation of members that are out of position.

BRIEF SUMMARY OF THE INVENTION

An object of the present invention is to provide cartridges, a method of inserting these, and an image forming device using these whereby the operative can easily notice incorrect insertion of cartridges, of which there are a plurality.

In order to achieve the above said object, a cartridge according to one aspect of the present invention comprises a guide for guiding insertion of other cartridges into the main device body in a state that the cartridge is inserted in a prescribed position in the main device body.

The guide may preferably be constructed such as to prevent insertion of other cartridges into the main device body when the cartridge is located at other than the said prescribed position in the main device body.

Also, the main device body comprises a second guide, in cooperation with which the guide of the cartridge guides insertion of other cartridges into the main device body.

Further, the guide of the cartridge and the second guide in the main device body may preferably be constructed such as to prevent insertion of other cartridges into the main device body when the cartridge is located at other than the said prescribed position in the main device body.

In this way, if the next cartridge is inserted whilst the cartridge that should have been inserted first is uninserted, this next cartridge will not be able to be guided by the guide section of the cartridge that should have been inserted first. Or, if the next cartridge is inserted whilst the insertion position of the previously inserted cartridge is incorrect, it will not be properly guided by the guide section of the previously inserted cartridge so, in either case, the next cartridge will either be impossible to insert or difficult to insert. Consequently, the operator can easily learn either that the insertion order is wrong due to the cartridge which should be inserted first not being inserted or that, even if this has been inserted, it has not been inserted correctly. Consequently, a plurality of cartridges can be inserted in correct sequence by correctly inserting the first cartridge or the next cartridge can easily be inserted into the correct position by correct guidance due to the guide section of the previous correctly inserted cartridge, or with such guidance.

Further, since the guide of the cartridge guides insertion of other cartridges in cooperation with the second guide provided in the main device body, the guide needs to constitute only a part of the necessary insertion path, thus contributing to decrease in dimensions of the cartridge.

Other and further objects, features and advantages of the invention will appear more fully from the following description.

DETAILED DESCRIPTION OF PREFERRED EMBODIMENTS

A typical embodiment of the present invention is described below in detail with reference to the drawings.

Figure 1:
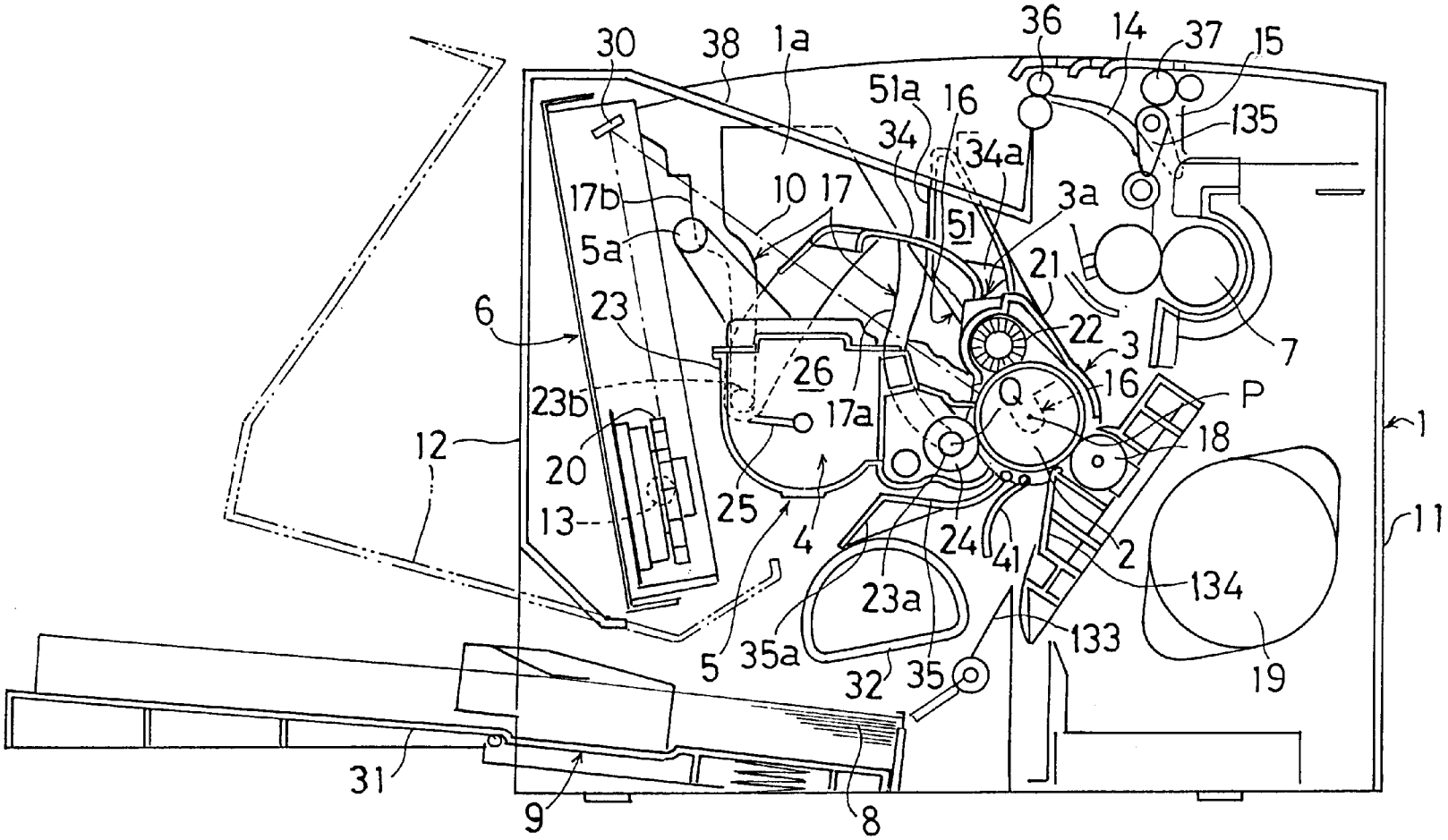
FIG. 1 is an overall layout diagram showing an image forming device according to a typical embodiment of the present invention.

This embodiment is an example of the case of a small-size laser printer that outputs an image signal of a computer; the overall layout is shown in FIG. 1. As shown in FIG. 1, in the middle portion of main device body 1, there are provided a photosensitive cartridge 3 in which is installed a photosensitive drum 2 constituting an image carrier, and a developer cartridge 5 in which is installed a developer 4 that performs toner development of a latent image formed on photosensitive body drum 2. On the left side in this FIG. 1 there is provided a print head 6 that performs image exposure on photosensitive body drum 2, and at the top of the right side in FIG. 1 there is provided a fixer 7 that performs fixing treatment by pressure and heating transfer member 8 on to which the visible image has been transferred from photosensitive body drum 2. On the bottom left side of FIG. 1 of main device body 1 there is provided a paper-feed section 9 that supplies papers 8 to the transfer section from photosensitive body drum 2. At the bottom left side of FIG. 1 there is provided a stepping motor 19 constituting a main drive source.

Main device body 1 has a construction which is divided into two, namely, a fixed frame 11 and a cover frame 12. The front of main device body 1 is on the left side of FIG. 1. Cover frame 12 is pivoted such that it can rotate by means of a shaft 13 at the front lower part of fixed frame 11, being opened and closed by rotation about shaft 13 between a closed position shown by the continuous line in FIG. 1 and an open position shown by the imaginary line. By opening cover frame 12, the main device body 1 can be opened upwards in the portion excluding the left and right side frame 1*a* section in fixed frame 11 and the ceiling portion on the inside of which there are provided fixer 7 and the two paper discharge paths 14 and 15 and whence a transfer member that has been fixed thereby is discharged to outside main device body 1. Through this open portion, photosensitive body cartridge 3 and developer cartridge 5 can be inserted or removed in a prescribed sequence and by a prescribed insertion path formed with guide grooves 16, 17 that are formed in side frame 1*a*.

Photosensitive body drum 2 of this embodiment is an organic photosensitive body. For developer 4, the so-called reverse transfer development system, in which toner is made to adhere by development bias to portions where the charge has been lowered by image exposure of photosensitive body drum 2 is employed. It should be noted that the cleaning device whereby the surface of photosensitive body drum 2 is cleaned after transfer is not shown. Print head 6 forms a latent image corresponding to the image signal on the surface of photosensitive body drum 2 by auxiliary scanning produced by the rotation of photosensitive body drum 2 and main scanning, in which a laser beam 10 modulated by an image signal transferred from an external host device, for example a microcomputer 20, is directed in the axial direction of photosensitive body drum 2 whilst being deflected by polygonal mirror 30.

Within the casing 21 of photosensitive body cartridge 3 there are accommodated a photosensitive body drum 2 and a charging brush 22 that uniformly charges up the surface of this in order to effect image exposure. Within casing 23 of developer cartridge 5, there are accommodated a developing roller 24 and toner shaking roller 25. The toner in toner tank 26, whilst being shaken by toner shaking roll 25, is carried on developing roll 24, and developing roll 24 transports this to photosensitive body drum 2 where a latent image is developed under prescribed developing bias.

Transfer roller 18 for transferring the toner image on photosensitive body drum 2 to transfer member 8 is mounted in a prescribed position of fixed frame 11 and effects transfer, facing in a prescribed positional relationship this photosensitive body drum 2, when photosensitive body cartridge 3 is inserted as far as the prescribed position.

Paper-feed section 9 is constituted such that transfer members 8 are inserted from the front face side on to paper-feed platen 31 provided on fixed frame 11. Transfer members 8 are fed, one sheet at a time, from the uppermost layer, by rotation of paper-feed roller 32 mounted in a prescribed position of fixed frame 11, and are thence supplied to the transfer section under guidance by sheet guides 133, 134. The transfer member 8 is then fed on to fixer 7 whilst being subjected to transfer by the electrostatic action occurring between photosensitive body drum 2 and transfer roll 18 in the transfer section. After being subjected to transfer, transfer member 8 is subjected to fixing treatment in fixer 7 and is then conveyed to one or other of paper discharge paths 14, 15 set by means of a passage changeover claw 135 and is discharged by paper discharge rollers 36, 37 that are provided therein to paper-discharge tray 38 which is formed on cover frame 12, or to the other surface of the main device body 1.

As described above, photosensitive body drum 2 must be maintained with high precision in the correct positional relationship with respect to charging brush 22, print head 6, developer 4, and transfer roll 18 etc., since these contribute to image formation therewith. Regarding charging brush 22, high-precision mutual positional location can easily be achieved, since this constitutes integral photosensitive body cartridge 3 by means of casing 21 together with photosensitive body drum 2.

With regard to print head 6 and transfer roll 18, photosensitive body drum 2 must be set and located in position with high precision in regard to the position of its axis P and its attitude about this axis P. For this reason, photosensitive body cartridge 3 is located in position with high precision in the prescribed position with priority over developer cartridge 5 by inserting photosensitive body cartridge 3 into main device body 1 along the prescribed insertion path along guide groove 16 prior to developer cartridge 5. Developer cartridge 5 is then located in position with high precision with respect to photosensitive body drum 2 by insertion by the prescribed insertion path along guide groove 17 in main device body 1.

Figure 4:
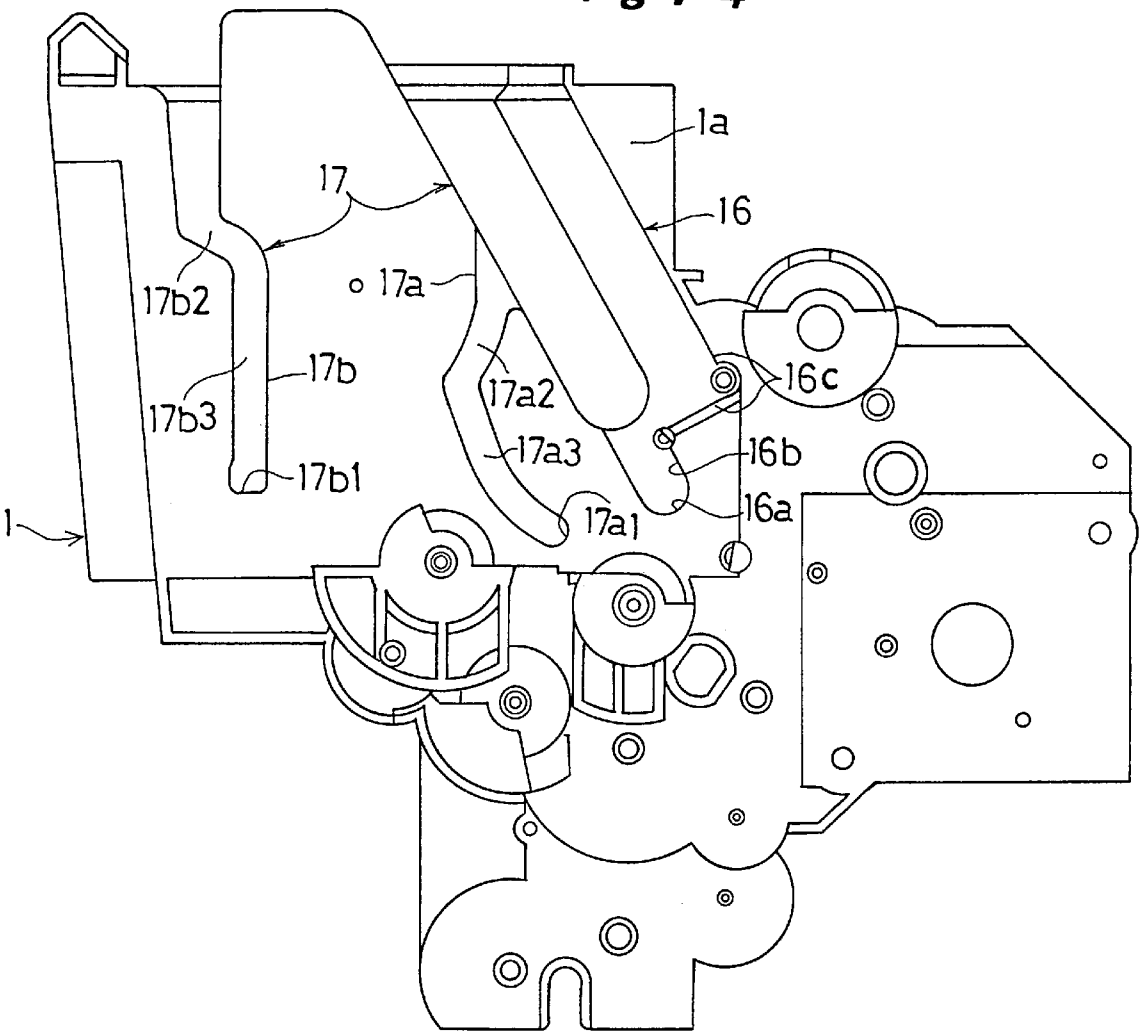
FIG. 4 is a front view of a side frame having a guide groove whereby insertion/removal of the photosensitive body cartridge and developer cartridge of the device of FIG. 1 are guided along a prescribed path.
Figure 5:
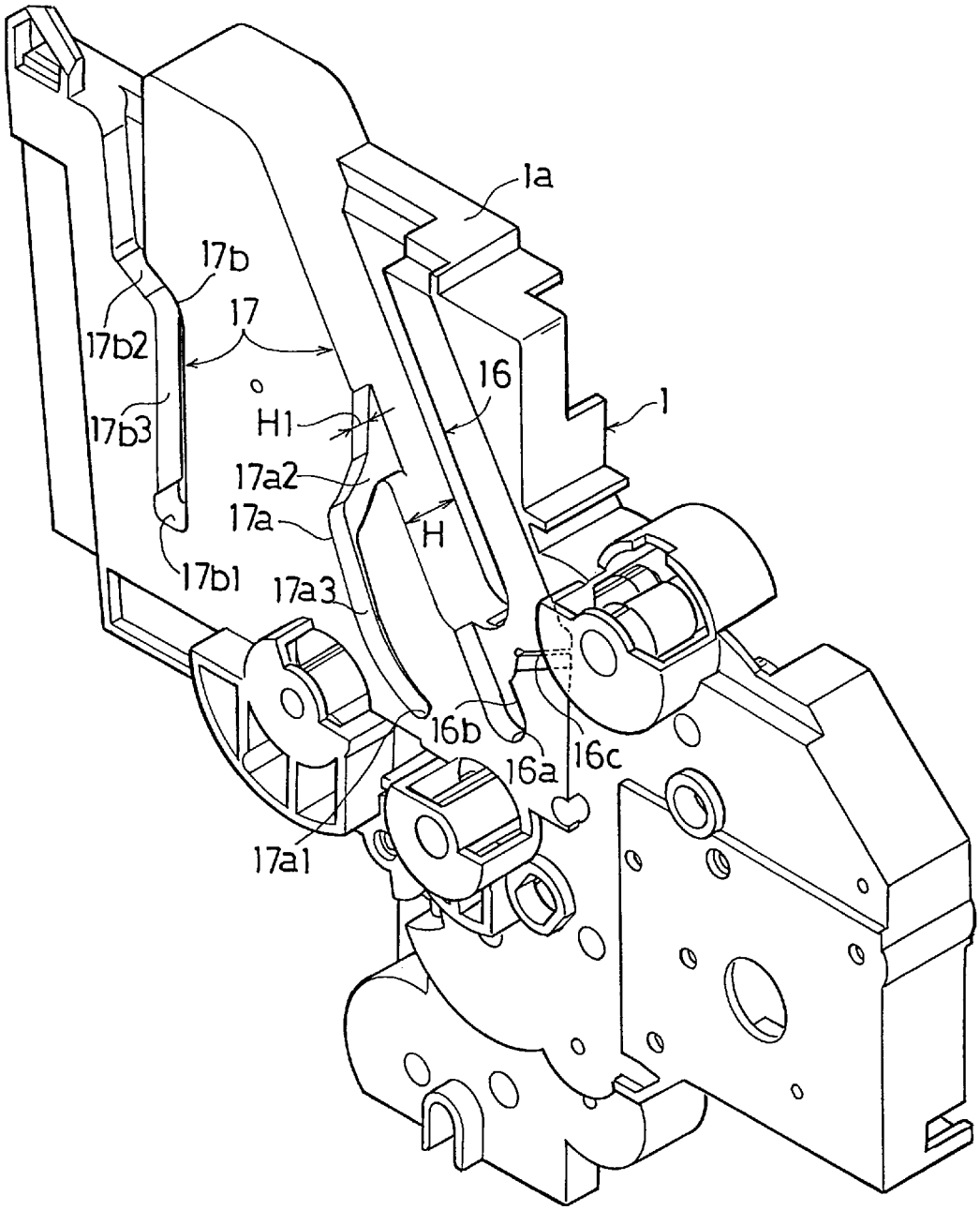
FIG. 5 is a perspective view of the side frame of FIG. 4.
Figure 6:
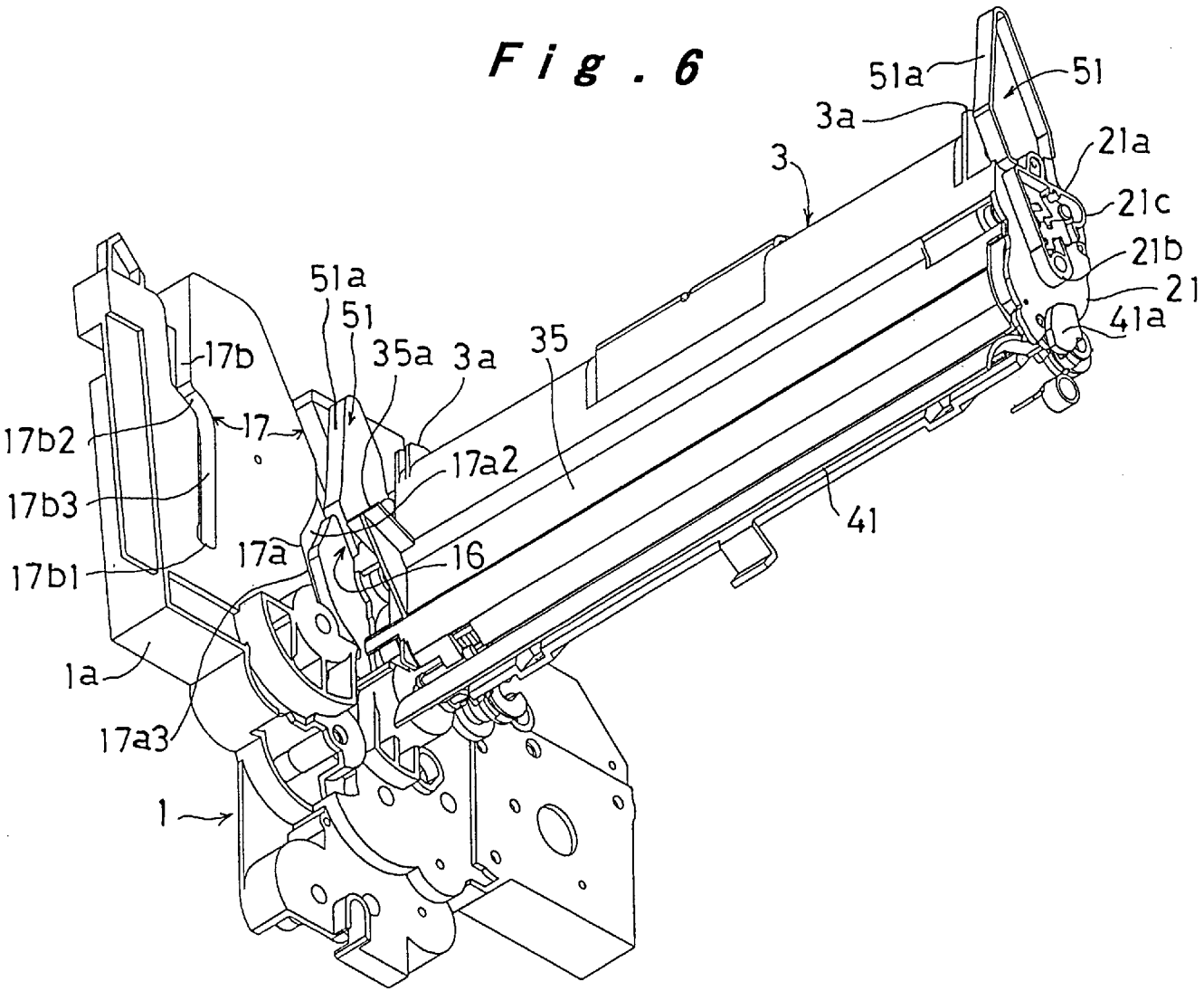
FIG. 6 is a perspective view showing the relationship of the guide groove of the side frame and the photosensitive body cartridge when the photosensitive body cartridge of FIG. 2 is inserted in a prescribed position in the main device body.

As shown in FIG. 1, FIG. 4, FIG. 6 and the subsequent Figures, guide groove 16 of this embodiment facilitates insertion or removal of photosensitive body cartridge 3 from the front face of main device body 1 by being formed in a shape extending in a straight line which is somewhat inclined from the front top to the rear bottom from the upper face position of side frame 1*a* to the portion where the axis of photosensitive body drum 2 is to be positioned, at the inside face of side frame 1*a* of main device body 1. Also, guide groove 16 is constituted as a comparatively large groove having a width of about ⅔ of the width in the direction shown in FIG. 7 at right angles to the insertion/removal direction of photosensitive body cartridge 3 and a height H shown in FIG. 5 of about ½ of this width. Correspondingly, in photosensitive body cartridge 3, there is formed a guided section 21*a* that projects in the axial direction of photosensitive body drum 2 at both ends of this casing 21 as shown below in FIG. 1, FIG. 2 and FIG. 6. By fitting of this guided section 21*a* in guide groove 16, photosensitive body cartridge 3 is guided so as to be inserted into or removed from a prescribed position in main device body 1 by a prescribed insertion path along guide groove 16. In particular, since the fitted portion is large, photosensitive body cartridge 3 is guided such that it is inserted or removed in a smooth manner without any possibility of shaking or twisting etc. of photosensitive body cartridge 3.

Figure 7:
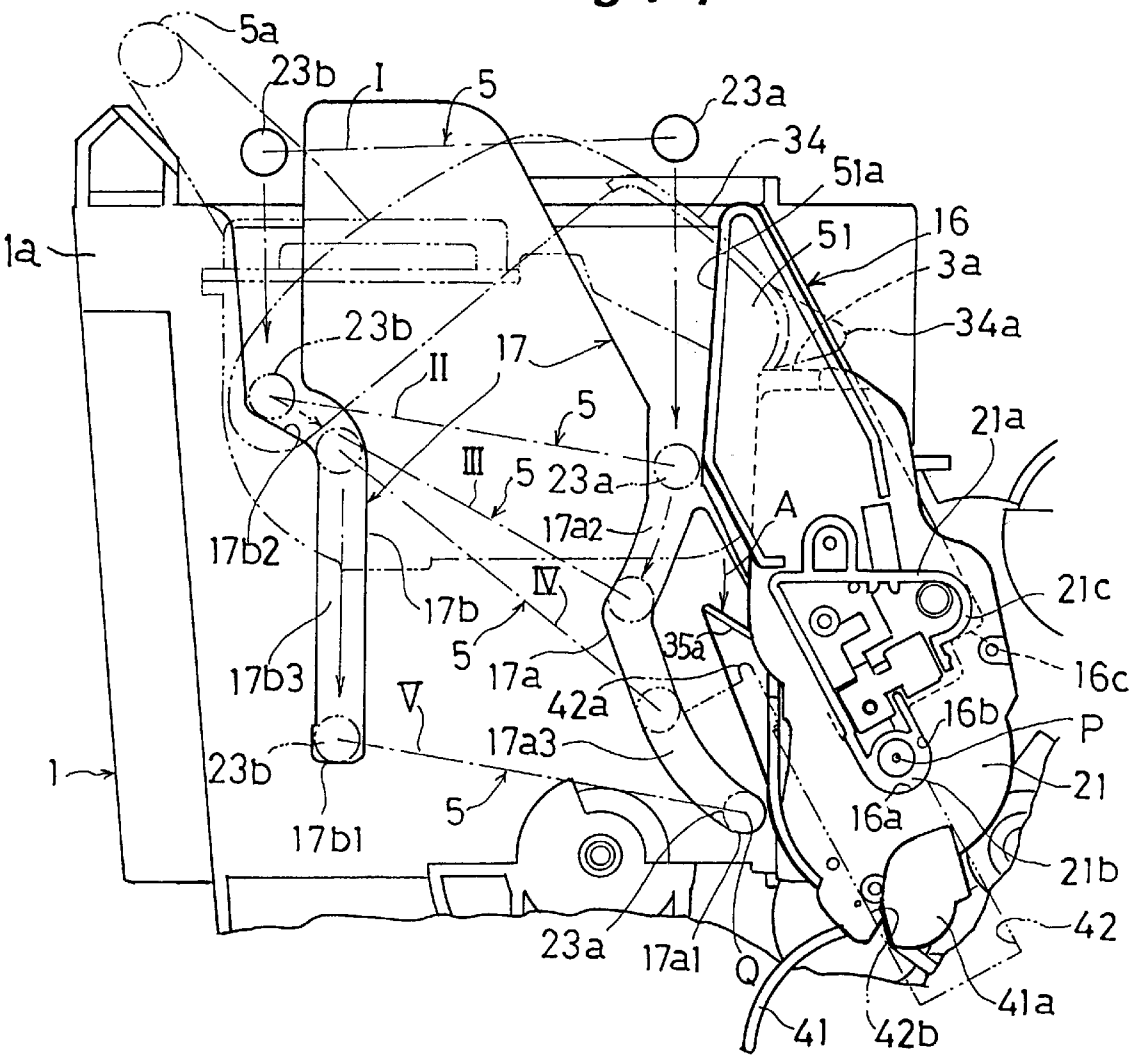
FIG. 7 is a diagram given in explanation of the operation when the photosensitive body cartridge of the device of FIG. 1 followed by the developer cartridge are inserted.

Furthermore, as shown in FIG. 7, it is arranged that insertion and removal of guided section 21*a* can be performed even more smoothly and without frictional resistance due to easy fitting guidance which is achieved by making its width a little smaller than the width of guide groove 16. Furthermore, a radiused face 16*a* which is downwardly curved is provided at the bottom end of guide groove 16, the centre point of this radiused face 16*a* being concentric with the axis P of photosensitive body drum 2 at a prescribed position within main device body 1. Furthermore, a positional location guide groove 16*b* is provided that extends upwards parallel to guide groove 16. Axis P of photosensitive body drum 2 is located in position with high precision in a position that is concentric with respect to radiused face 16*a* of positional location guide groove 16 and its direction about axis P is defined with high precision by insertion without difficulty and without any gap of positional location guided section 21*b* having a downwardly-directed radiused face provided at the bottom end of guided section 21*a* in this guide groove 16*b*.

Also, a positional location corner section 21*c* whose surface is radiused is formed on guided section 21*a* in a portion on the opposite side and above positional location guided section 21*b*. Correspondingly, in guide groove 16, there is provided a positional location corner section 16*c* of a right angled shaped on the opposite side to positional location guide groove 16*b*. Photosensitive body cartridge 3 can thus easily be stabilised in a condition with positional location effected with high precision thanks to the mutual contact from two directions of this positional location corner section 21*c* and positional location corner section 16*c*.

Contrariwise, when photosensitive body cartridge 3 is withdrawn along the prescribed insertion path along guide groove 16, guided section 21*a* is guided in guide groove 16, so it can be easily removed from main device body 1 without shaking or twisting.

In this way, on insertion or removal of photosensitive body cartridge 3, it can be inserted or removed along the prescribed insertion path defined by guide groove 16 without shaking or twisting of photosensitive cartridge 3, so mutual interference with the various devices installed in the main device body 1 and damage to both of these due to such interference can be avoided.

Of course, insertion and removal of photosensitive body cartridge 3 into main device body 1 can be effected by a path of any form and the cartridge itself and the shape of the peripheral devices and their relative positional relationships can be designed in various ways. In this embodiment, transfer section shutter 41 as shown in FIG. 1, 6, 7–9 is arranged to open utilising relative movement with respect to main device body 1 that occurs accompanying insertion of photosensitive body cartridge 3, but it could be designed so as to satisfy other required conditions in addition to this. Transfer section shutter 41 of this embodiment is normally closed, being biased by a spring (not shown) towards the closed position.

Figure 2:
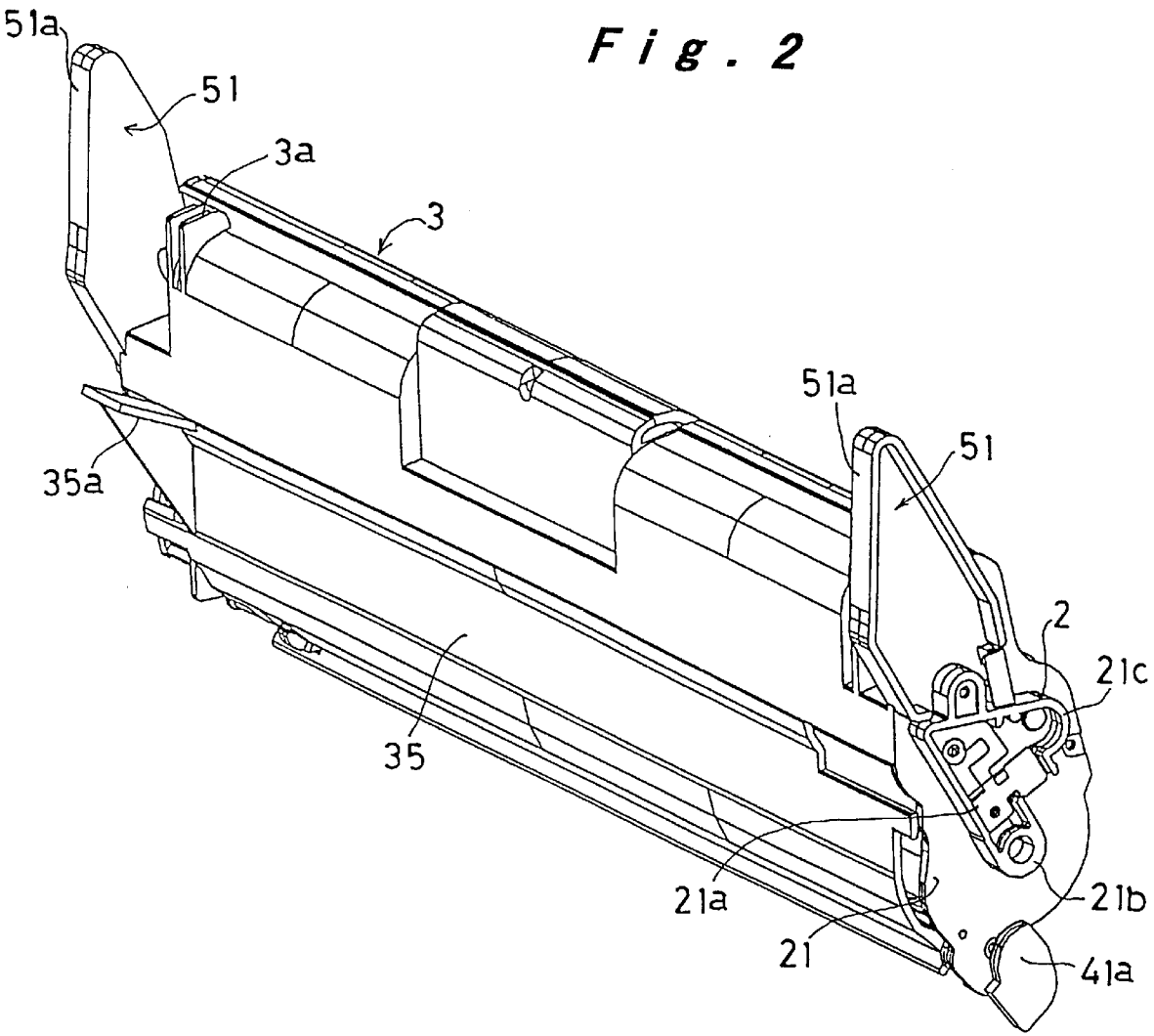
FIG. 2 is a perspective view showing a photosensitive body cartridge of the device of FIG. 1.
Figure 3:
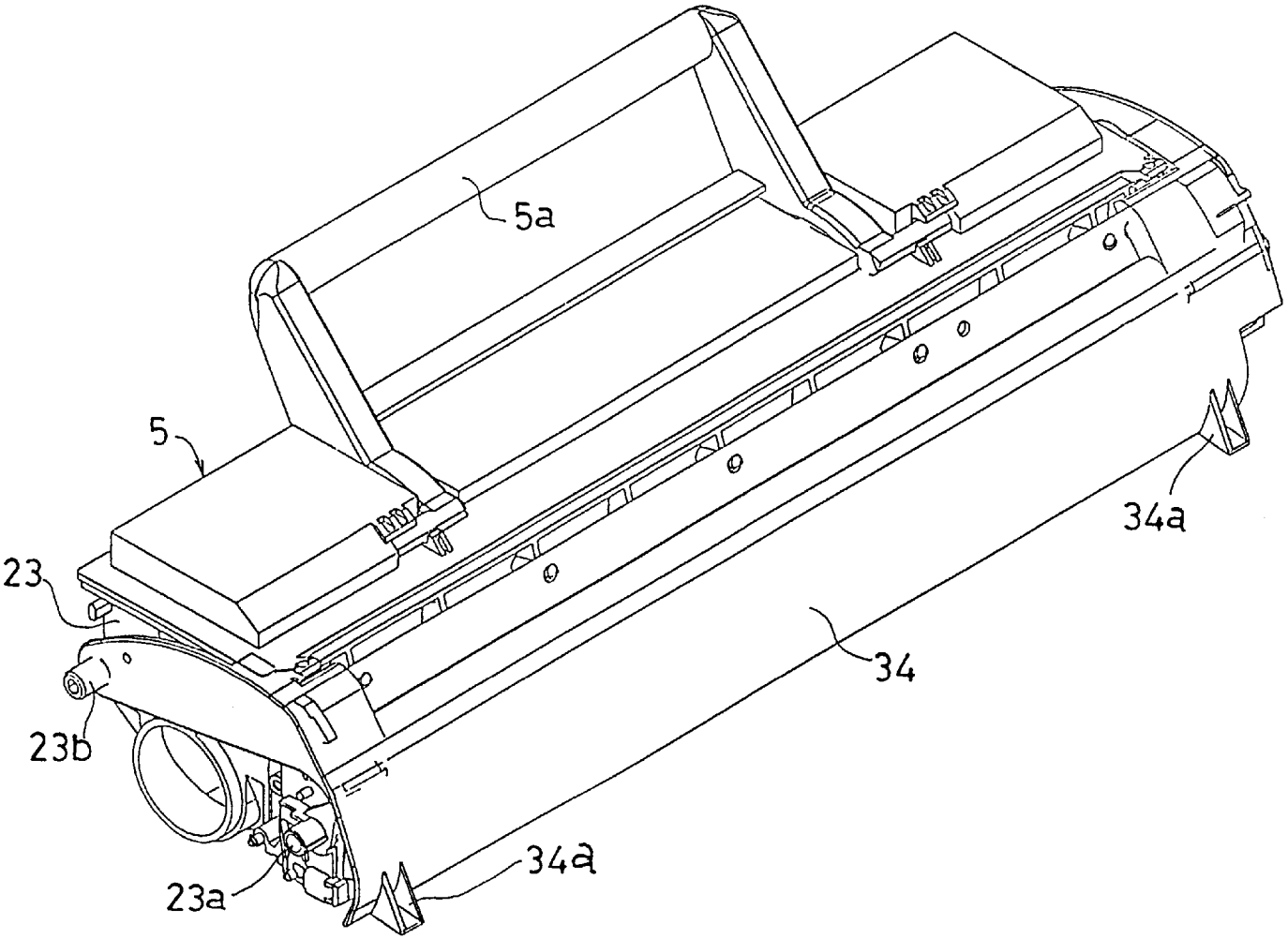
FIG. 3 is a perspective view showing a developer cartridge of the device of FIG. 1.

As shown in FIG. 2, FIG. 6 and the following Figures, this transfer section shutter 41 is provided with a driven cam 41*a* at one end of casing 21 of photosensitive body cartridge 3 so that it is automatically pushed open at a prescribed time-point when photosensitive body cartridge 3 is inserted into main device body 1 and in order that photosensitive body drum 2 should then be opposite transfer roll 18. When photosensitive body cartridge 3 is inserted along the prescribed insertion path along guide groove 16 in main device body 1, driven cam 41*a* effects contact from above with a contact section 42*a* of guide groove 42 shown in FIG. 7 and the subsequent Figures which is provided on a side frame (not shown) on the opposite side to side frame 1*a* shown in FIG. 1 and FIG. 4 of main device body 1. Driven cam 41*a* is rotated by this contact from the direction shown by the imaginary line in FIG. 9 to the direction shown by the continuous line, causing transfer section shutter 41 to operate such that it is pushed open in a manner linked to this and against its biasing force towards the closed position.

When photosensitive body cartridge 3 is withdrawn, transfer section shutter 41 is maintained in an open condition up to the time-point where driven cam 41*a* moves away upwards from contacting section 42*a*, thanks to sliding contact of driven cam 41*a* with a guide face 42*b* of guide groove 42 that is parallel to guide groove 16. Since driven cam 41*a* becomes free if photosensitive body cartridge 3 is withdrawn by the time driven cam 41*a* has moved away from contacting section 42*a*, transfer section shutter 41 then returns to the closed condition, so that, even though photosensitive body cartridge 3 has been removed, the transfer section of photosensitive body drum 2 is protected from external force.

A handle 5*a* is provided for the operation of insertion or removal of developer cartridge 5 into or from main device body 1. At both ends of casing 23, there are provided guided sections 23*a*, 23*b* that project in the manner of shafts in the axial direction of developer roll 24, two of these being provided in each case at the front and rear; a guide groove 17 for guiding these is formed as guide grooves 17*a*, 17*b* separately provided in two locations, at the front and the rear, of the inside face of side frame 1*a*. The two guided sections 23*a*, 23*b* are respectively individually guided in guide grooves 17*a*, 17*b* and a path is thereby defined whereby cartridge 5 can be inserted into or removed from main device body 1. However, there is no restriction to this construction and the path could be formed by a single groove such as guide groove 16.

In particular, guided section 23*a* on one side is provided so as to be concentric with developing roll 24 and this is constrained by bottom end section 17*a*1 of guide groove 17*a* such that the axis of developing roll 24 is positioned in the prescribed position that is required in respect of photosensitive body drum 2 which is located in position within main device body 1 with the high precision mentioned above. Guided section 23*b* on the other side is constrained in a prescribed position within main device body 1 by the bottom end section 17*b*1 of guide groove 17*b*, thereby defining the direction of developer cartridge 5 about axis Q of developing roll 24 that is located in position at the bottom end of guide groove 17*a*.

Guide grooves 16, 17 are formed such that, at a prescribed time-point during the progress of insertion of developer cartridge 5 to its prescribed position in main device body 1 guided by fitting of guided sections 23*a*, 23*b* and guide grooves 17*a*, 17*b*, driven section 34*a* of developing section shutter 34 of developer cartridge 5 is in a positional relationship such that it faces from above abutment section 3*a* provided on the top of photosensitive body cartridge 3 which has been previously inserted in prescribed position in main device body 1 guided by guide groove 16. The inlets of guide grooves 17*a*, 17*b* are formed a few times wider than guided sections 23*a*, 23*b* to facilitate introduction of guided sections 23*a*, 23*b*. The inlet of guide groove 17*b* is made narrower than the inlet of guide groove 17*a* at a position before it becomes shallower so that positional location in the forwards/rearwards direction of guided section 23*b* is effected earlier, ensuring that driven section 34*a* of developing section shutter 34 is positively brought up opposite abutment section 3*a*. In this connection, guide groove 17*a* is formed wider up to the position where it is deeper than guide groove 17*b*, such as to confer a degree of freedom in the attitude of developer cartridge 5 to the extent of the amount of play between this and guided section 23*a*. Developer cartridge 5 can thereby easily be inserted from the position shown by I in FIG. 7 to position II.

Also, one guide groove 17*b* has a shelf section 17*b*2 to catch guided section 23*b* by being bent rearwardly at a portion midway along the path of insertion of developer cartridge 5 to the position II indicated by the imaginary line in FIG. 7. For its part, the other guide groove 17*a* has a curved section 17*a*2 that is curved in arcuate fashion so as to coincide with the track of the movement of guided section 23*a* when guided section 23*a* of developer cartridge 5 is rotated downwards to the position III about guided section 23*b* that has been caught by shelf section 17*b*2 during its movement along the path. By means of these arrangements, even though developer cartridge 5 that has been inserted as far as the position II shown by imaginary lines in FIG. 7 is attempted to be inserted, still in the same attitude, by parallel movement towards the prescribed position shown by the continuous lines in FIG. 8, guided sections 23*a*, 23*b* are caught by shelf section 17*b*2 and curved section 17*a*2, preventing further downwards movement.

By movement rotating in the downward direction of guided section 23*a* of developer cartridge 5 about guided section 23*b* in a condition in which it has been caught by shelf section 17*b*2 in the insertion position shown at II, guided section 23*a* moves downwards along curved section 17*a*2 with the result that developer cartridge 5 is inserted in the position III shown in FIG. 7. By this rotation of developer cartridge 5, developing section shutter 34 is pushed even more widely open from the condition shown by imaginary lines in FIG. 7 and part of the casing 23 of developer cartridge 5 commences downwards pushing movement of driven section 35*a* of developed section shutter 35 of photosensitive body cartridge 3 as shown by arrow A in FIG. 7, causing developed section shutter 35 to be pushed open towards the downwardly opening position shown in FIG. 8.

Figure 8:
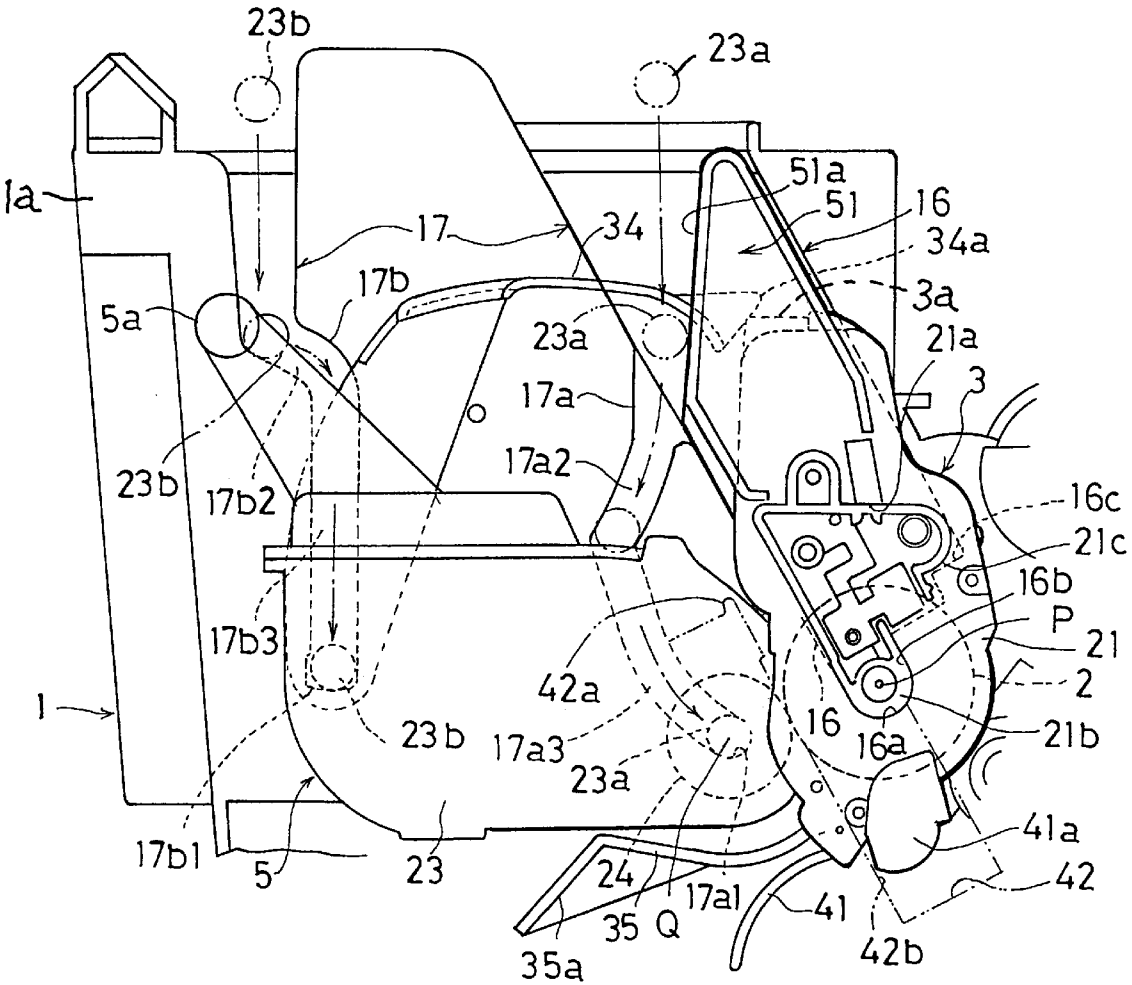
FIG. 8 is an explanatory diagram illustrating the condition when the developer cartridge of the device of FIG. L is inserted in a prescribed position.

Continuing from curved section 17*a*2, guide groove 17*a* has a bent section 17*a*3 that is bent on the opposite side to the curved section 17*a*2. Guiding guided section 23*a*, the bent section 17*a*3 brings developing roll 24 up to the position where there is a prescribed positional relationship of previously inserted photosensitive body cartridge 3 with respect to photosensitive body drum 2. Finally, developing roll 24 is guided to its prescribed position within main device body 1 by guiding guided section 23*a* to bottom end section 17*a*1 and, concurrently, guided section 23*b*, by tracking the movement of guided section 23*a* during this process, is inserted as far as bottom end section 17*b*1 of straight section 17*b*3, which is continuous with shelf section 17*b*2 of guide groove 17*b*. In short, developer cartridge 5, passing through the position IV shown in FIG. 7, reaches the prescribed position in main device body 1 shown by continuous lines in FIG. 8 shown at V in FIG. 7 and is inserted with high precision facing photosensitive body drum 2 in the prescribed position and direction.

As described above, although constituted by a portion that is narrow in comparison with guide groove 16 and guided section 21*a* of photosensitive body cartridge 3, the positionally located condition of developer cartridge 5 is maintained stably and with high precision by fitting at two locations with guide grooves 17*a*, 17*b* and guided sections 23*a*, 23*b*.

Contrariwise, when developer cartridge 5 is extracted, just as in the case of insertion, when developer cartridge 5 is withdrawn along guide grooves 17*a*, 17*b*, guided sections 23*a*, 23*b* at two locations are guided in guide grooves 17*a*, 17*b* and so, just as in the case of insertion, it can easily be extracted from main device body 1 without shaking or twisting. Since developing section shutter 34 and developed section shutter 35 automatically return to the closed condition simultaneously, developing roll 24 and photosensitive body drum 2 are protected from external force.

In this way, on insertion or removal of developer cartridge 5, developer cartridge 5 can be inserted or removed along the predetermined path defined by guide grooves 17*a*, 17*b* without shaking or twisting and interference of the cartridge itself with the various devices that are originally installed in main device body 1 and consequent damage can thereby be avoided.

Such insertion and removal of developer cartridge 5 into main device body 1 could be effected by a path of any form. The shape and positional relationships of the cartridge itself and peripheral devices could be designed in various other ways. For example, as in this embodiment, developing section shutter 34 and developed section shutter 35 shown in FIG. 7 could be designed so as to satisfy the various necessary conditions etc. involved in push-opening utilising relative movement with respect to photosensitive body cartridge 3 etc. accompanying insertion of developer cartridge 5.

In addition, in this embodiment, photosensitive body cartridge 3 is provided with a guide section 51 as shown in FIG. 1, FIG. 2, FIG. 6 and subsequent Figures. The purpose of this is that one of a plurality of cartridges removably inserted into a prescribed position of main device body 1 by a prescribed insertion path along guide grooves 16, 17 and in a prescribed sequence should be able to guide insertion of another cartridge that is subsequently inserted such as for example developer cartridge 5 into a prescribed position in main device body 1. As shown in FIG. 1, FIG. 6 and subsequent Figures, this guide section 51 comprises a guide face 51*a* that forms one face of an inlet section to curved section 17*a*2 of one guide groove 17*a* constituting guide groove 17. Consequently, when photosensitive body cartridge 3 is inserted, with high-precision positional location, in the prescribed position of main device body 1, guide groove 17*a* can smoothly perform insertion or removal of developer cartridge 5 by acting in co-operation with guide face 51*a* of this guide section 51.

Of course, if required, the subsequently inserted developer cartridge 5 could be guided solely by the guide section 51 of the previously inserted photosensitive body cartridge 3.

Thanks to the above construction, if developer cartridge 5, which ought to be inserted subsequently, is inserted even though photosensitive body cartridge 3, which ought to be inserted first, has not been inserted, developer cartridge 5 will not be able to be guided by guide section 51 of photosensitive body cartridge 3, which ought to be inserted first. Also, if, notwithstanding that the insertion position of previously inserted photosensitive body cartridge 3 is incorrect as shown for example in FIG. 9 and FIG. 10, developer cartridge 5 that is to be inserted next is inserted, as shown at VI and VII in FIG. 9, cartridge 5 cannot be correctly guided since its insertion is obstructed by guide section 51 which is in a condition blocking guide groove 17*a*. Or, as shown in VIII and IX of FIG. 10, correct guidance cannot be achieved since insertion is obstructed due to guide section 51 being in a condition in which guide groove 17*a* is only open to a small extent.

Consequently, in either case, due to the fact that the subsequent developer cartridge 5 either cannot be inserted or can be inserted only with difficulty the operator can easily be made aware either that there is an error of insertion sequence in that the photosensitive body cartridge 3 which ought to be previously inserted is absent or that, if it has been inserted, it has not been inserted correctly. Accordingly, the operator may correctly insert photosensitive body cartridge 3 that is to be inserted first and may insert photosensitive body cartridge 3 and developer cartridge 5 in the correct sequence. Also, developer cartridge 5 that is to be inserted subsequently can easily be inserted into the correct position by correct guidance as shown in FIG. 7 and FIG. 8 by guide section 51 of photosensitive body cartridge 3 that has previously been correctly inserted. This construction is therefore beneficial in the case of a laser beam printer constituting an image forming device of the electrophotographic type as in this embodiment wherein developer 4 and photosensitive body drum 2 constituting an image carrier, for which high-precision positional location is necessary, are constituted with a separate photosensitive body cartridge 3 and developer cartridge 5.

Figure 9:
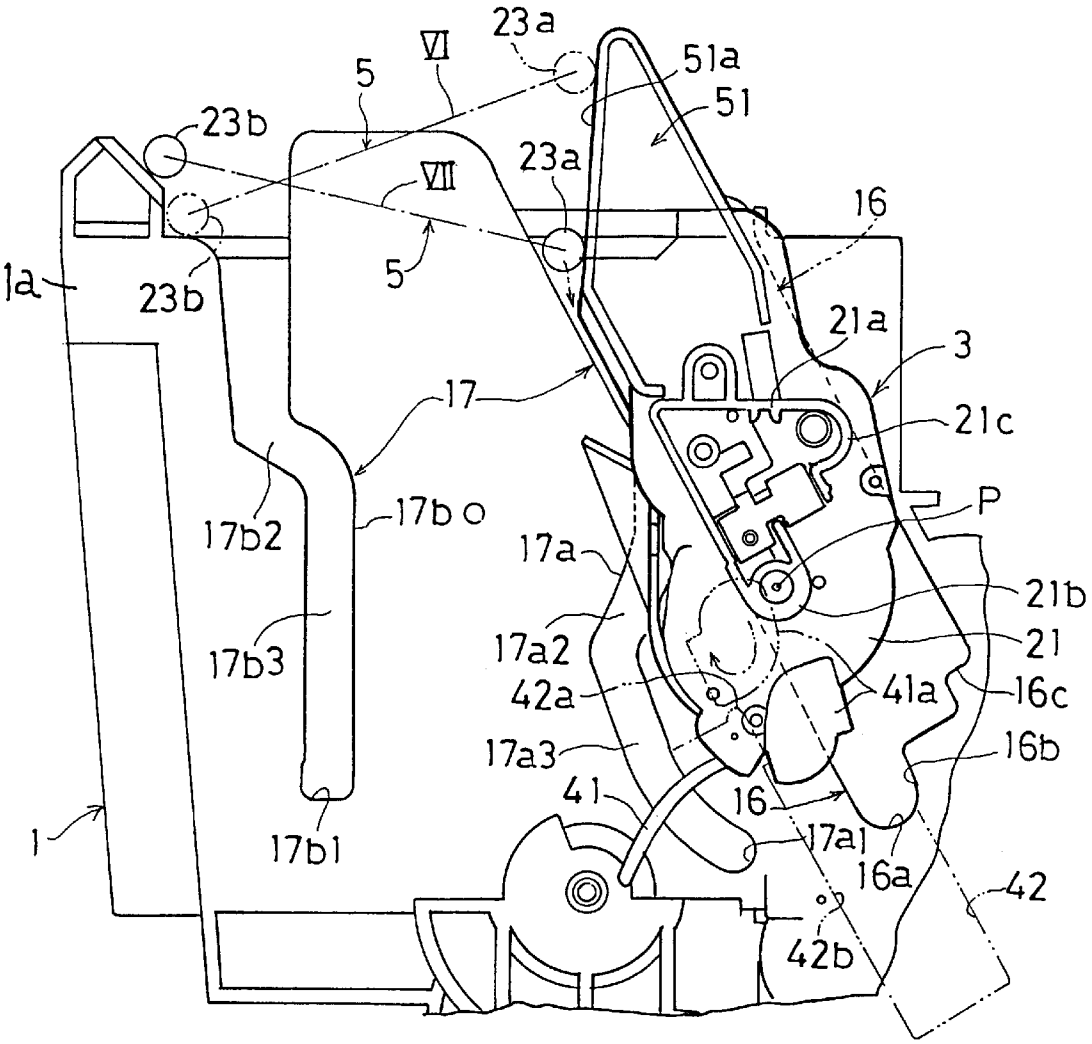
FIG. 9 is an explanatory diagram showing the condition of insertion of the developer cartridge when the photosensitive body cartridge has not been correctly inserted.
Figure 10:
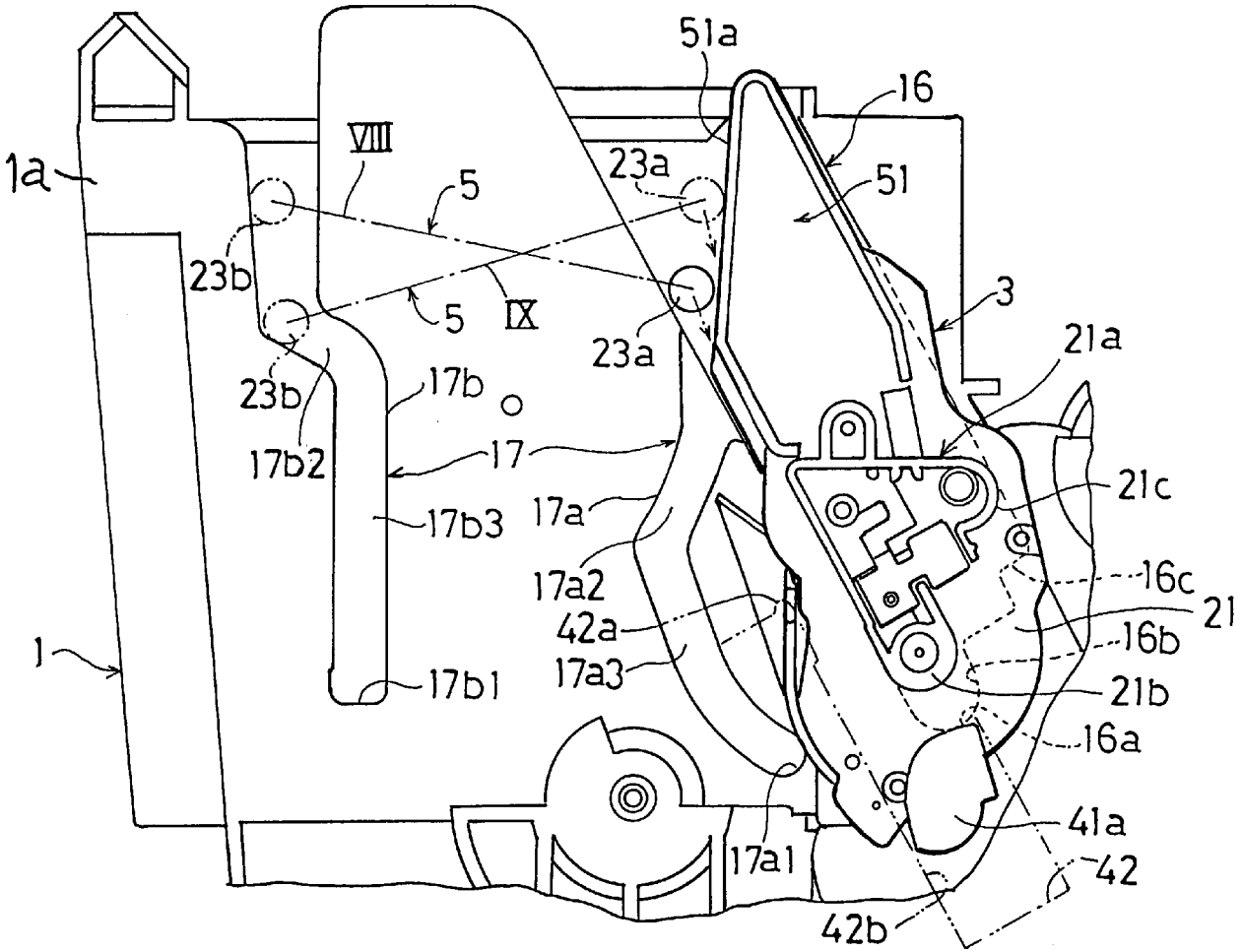
FIG. 10 is an explanatory diagram showing the condition of insertion of the developer cartridge when the photosensitive body cartridge has not been correctly inserted.

Furthermore, if developer cartridge 5 is in an incorrectly inserted condition as shown in FIG. 9 or FIG. 10, part thereof projects above main device body 1 and interferes with cover frame 12 shown in FIG. 1, thereby obstructing closure of this cover frame 12 until it is in the correct position. This therefore enables use when developer cartridge 5 is in an incorrectly inserted condition as shown in FIG. 9 or FIG. 10 to be reliably prevented. If it is arranged for it to be impossible to close cover frame 12 until developer cartridge 5 has reached a position close to the correct insertion position shown in FIG. 8 in which it can be guaranteed to reliably drop into the correct insertion position by its own weight, use with developer cartridge 5 incorrectly inserted can be reliably prevented.

If for example as shown in FIG. 10, even though photosensitive body cartridge 3 has not been correctly inserted, developer cartridge 5 is in an insertion condition to the extent shown by VIII in FIG. 10, when developer cartridge 5 is inserted towards the prescribed insertion position, developer cartridge 5 can be inserted to the prescribed position whilst pushing photosensitive body cartridge 3 into its prescribed position through guide section 51 by means of guided section 23*a*. In this process, the resistance to the operation is somewhat greater than normally owing to the insertion load acting on photosensitive body cartridge 3, but, if the operation is performed with an awareness that photosensitive body cartridge 3 is in an incorrect insertion condition, by slowly applying sufficient force taking this into account reliable insertion can be achieved. By this means, the inconvenience of having to temporarily remove developer cartridge 5 whose insertion had just been begun and then re-insert developer cartridge 5 after correctly re-inserting photosensitive body cartridge 3 can be avoided.

If it is arranged for guide section 51 of photosensitive body cartridge 3 alone to guide subsequent insertion of developer cartridge 5, this in particular makes it easier to notice whether or not photosensitive body cartridge 3, that ought to be inserted first, has been inserted or not or has been inserted correctly or incorrectly, since, if photosensitive body cartridge 3 has not been inserted, developer cartridge 5 is completely impossible to insert and if photosensitive body cartridge 3 has not been inserted correctly developer cartridge 5 cannot be correctly guided. However, if this is done, the guide section associated with photosensitive body cartridge 3 has to be large, making the device bulky. But if it is made to act co-operatively with a guide associated with the main device body 1 constituted in this embodiment by guide groove 17*a* etc., the size of guide section 51 can be made smaller in a ratio corresponding to the extent of this co-operation.

In this embodiment also, part of guide groove 16 and part of guide groove 17 are made to be in a shared condition at their inlets, in order that guide section 51 should co-operate with guide groove 17*a* of main device body 1. However, as shown in FIG. 5, by making the guide groove 17 of a depth H1 that is about ½ of the depth H of guide groove 16, guide groove 16 can guide photosensitive body cartridge 3 without being affected by guide groove 17, and guided sections 23*a*, 23*b* of developer cartridge 5 are reliably guided into the prescribed position by guide grooves 17*a*, 17*b* and guide face 51*a* of guide section 51. Also, if photosensitive body cartridge 3 is not inserted, it is easy to notice that photosensitive body cartridge 3 has not been inserted, owing to the difficulty of insertion of guided section 23*a* of developer cartridge 5 into guide groove 17*a*, which opens in a shallow and narrow manner at the inlet to the wide and deep guide groove 16, since guide section 51 does not then form part of guide groove 17*a*.

Guide section 51 is provided in a thickness and position corresponding to the depth and position of guide groove 17 and extends in the direction along guide groove 16 to above photosensitive body cartridge 3 in a condition raised by an amount H-H1 from the bottom of guide groove 16. Consequently, guide section 51, in a condition wherein photosensitive body cartridge 3 is inserted into its prescribed position in main device body 1, has its upper end positioned at the inlet of guide groove 16 but is separated from the bottom thereof, so it serves as a handle when photosensitive body cartridge 3 is removed from main device body 1 or inserted into its prescribed position. Of course, a handle specifically for insertion or removal could be provided just as in the case of developer cartridge 5.

In a case where there are three or more cartridges such as photosensitive body cartridge 3 and developer cartridge 5, although not shown in the drawings, a cartridge whose order of insertion is intermediate will be provided with both a guide section whereby insertion of a cartridge that is inserted into the main device body subsequently is guided to its prescribed position in the main device body and a guided section whereby its insertion into its prescribed position in the main device body is guided, by means of the guide section provided on the cartridge that was previously inserted into its prescribed position in the main device body.

By this means a cartridge that is provided with both a guide section and guided section as described above can achieve the proper insertion sequence as between this cartridge and a previous cartridge that is to be inserted in front of it and between this cartridge and a later cartridge that is to be inserted after it and can achieve correctness of insertion therebetween of the cartridge that is to be inserted first and correctness of insertion of the cartridge that is to be inserted afterwards.

The case where three or more cartridges are provided as described above corresponds for example to the case where, in an image forming device as in the present embodiment wherein an image carried by a photosensitive body drum 2 is transferred to a transfer member 8 through an intermediate transfer body, not shown, a photosensitive body cartridge 3, developer cartridge 5 and intermediate cartridge (not shown) are arranged to be respectively independently inserted into and removed from main device body 1. However, apart from an image-forming device as above this invention could be applied to various equipment and mechanisms in which insertion or removal is to be effected in a prescribed order and by a prescribed path for purposes of maintenance and management of such various equipment and mechanisms.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cartridge which can be installed into a main device body with another cartridge, comprising:

a guide on the cartridge for guiding insertion of another cartridge into the main device body when the cartridge is inserted in a prescribed position in the main device body.

2. A cartridge according to claim 1, wherein the guide is constructed such as to prevent insertion of the another cartridge into the main device body when the cartridge is located at other than the said prescribed position in the main device body.

3. A cartridge according to claim 1, wherein the main device body comprises a second guide, which, in cooperation with which the guide of the cartridge, guides insertion of the another cartridge into the main device body.

4. A cartridge according to claim 3, wherein the guide of the cartridge and the second guide in the main device body are constructed such as to prevent insertion of the another cartridge into the main device body when the cartridge is located at other than the said prescribed position in the main device body.

5. A cartridge which can be installed into a main device body with another cartridge, comprising:

a guided section which is guided by a guide portion formed on another cartridge which has been inserted in a first usable position in the main device body, by which the cartridge is inserted in a second usable position in the main device body, wherein the cartridge is directly positioned by the main device body when the cartridge is in the second usable position.

6. A method of installing a plurality of cartridges into a main device body in a prescribed sequence, comprising the steps of:

a first inserting step of inserting a first cartridge in a first usable portion in the main device body; and a second inserting step of inserting a second cartridge into a second usable position in the main device body along a prescribed insertion path formed by the first cartridge that has been mounted in the first usable position, wherein the second cartridge is directly positioned by the main device body in the second usable position.

7. A method of installing a plurality of cartridges into a main device body in a prescribed sequence according to claim 6, wherein the second cartridge is inserted along an insertion path formed with a guide provided on the first cartridge.

8. A method of installing a plurality of cartridges into a main device body in a prescribed sequence according to claim 7, wherein the first cartridge is constructed such as to prevent insertion of the second cartridge into the main device body when the first cartridge is located at other than the said first prescribed position in the main device body.

9. An image forming device which is constructed such that a plurality of cartridges can be installed thereinto, comprising:

a main device body;

a first cartridge;

a first holder formed in the main device body for holding the first cartridge in a first prescribed position;

a second cartridge;

a second holder formed in the main device body for holding the second cartridge in a second prescribed position; and a guide formed on the first cartridge for guiding insertion of the second cartridge into the second prescribed position in a state that the first cartridge is held in the first prescribed position.

10. An image forming device according to claim 9, wherein the guide is constructed such as to prevent insertion of the second cartridge into the main device body when the first cartridge is located at other than the said first prescribed position in the main device body.

11. An image forming device according to claim 9, wherein the main device body comprises a second guide, in cooperation with which the guide formed on the first cartridge guides insertion of the second cartridge into the main device body.

12. An image forming device according to claim 11, herein the guide of the first cartridge and the second guide in the main device body are constructed such as to prevent insertion of the second cartridge into the main device body when the first cartridge is located at other than the said first prescribed position in the main device body.

13. An image forming device according to claim 9, wherein the second cartridge comprises a guided section which is guided by the guide formed on the first cartridge.

14. An image forming device which is constructed such that a plurality of cartridges can be installed thereinto, comprising:

a main device body;

a first cartridge;

a first holder formed in the main device body for holding the first cartridge in a first prescribed position;

a second cartridge;

a second holder formed in the main device body for holding the second cartridge in a second prescribed position; and a guided section formed on the second cartridge with which insertion of the second cartridge into the second prescribed position is guided by contacting to the first cartridge in a state that the first cartridge is held in the first prescribed position.

* * * * *